US012172099B1

(12) United States Patent
Yan

(10) Patent No.: US 12,172,099 B1
(45) Date of Patent: Dec. 24, 2024

(54) CRANE MACHINE WITH ROTATABLE ARM

(71) Applicant: Canqi Yan, Shantou (CN)

(72) Inventor: Canqi Yan, Shantou (CN)

( * ) Notice: Subject to any disclaimer, the term of this patent is extended or adjusted under 35 U.S.C. 154(b) by 0 days.

(21) Appl. No.: 18/533,835

(22) Filed: Dec. 8, 2023

(51) Int. Cl.
*A63H 33/30* (2006.01)

(52) U.S. Cl.
CPC ..... *A63H 33/3044* (2013.01)

(58) Field of Classification Search
CPC ..... A63H 33/3044; A63H 17/12
USPC ..... 446/424, 425, 426
See application file for complete search history.

(56) References Cited

U.S. PATENT DOCUMENTS 1,652,135 A * 12/1927 Arden ..... A63H 17/12 D21/537
1,660,780 A * 2/1928 Arden ..... A63H 17/12 D21/537
2,466,619 A * 4/1949 Stuckey ..... A63H 17/12 212/281
2,590,188 A * 3/1952 Landree ..... A63H 33/3044 212/243
2,858,642 A * 11/1958 Giardina ..... A63H 30/02 446/137
2,961,103 A * 11/1960 Ward ..... A63H 17/12 212/243
3,040,475 A * 6/1962 Reed ..... F41B 7/08 185/39
3,040,915 A * 6/1962 Theodore ..... A63H 33/3044 446/137
3,997,061 A * 12/1976 Sano ..... A63H 17/12 212/174
4,150,839 A * 4/1979 Tucker ..... A63H 33/00 280/771
4,316,346 A * 2/1982 Brand ..... A63H 18/00 446/443
4,961,716 A * 10/1990 Hippely ..... A63H 33/3044 414/917
5,299,905 A * 4/1994 Rademacher ..... A63H 17/12 254/297
5,413,515 A * 5/1995 Knox ..... A63H 17/12 446/85
6,475,058 B2 * 11/2002 Mammano ..... A63H 33/3044 446/425
7,927,176 B2 * 4/2011 Payne ..... A63H 18/00 446/72
9,643,098 B2 * 5/2017 Schneider ..... A63H 17/14
2005/0176338 A1 * 8/2005 Delaney ..... A63H 23/00 446/92

(Continued)

*Primary Examiner* — Joseph B Baldori

(57) ABSTRACT

The present disclosure provides a crane machine having a rotatable arm, including: a main body, the rotatable arm, a rotation drive assembly, an elevation drive assembly, and a gripper. The main body defines a holding cavity and a conveying channel; wherein the conveying channel includes an opening that is in communication with the holding cavity. The rotatable arm is arranged in the holding cavity. The rotation drive assembly includes a first driving member configured to drive the rotatable arm to rotate around the centerline. The elevation drive assembly is arranged in the rotatable arm and includes a second driving member and a rotation wheel. The gripper is connected to the rotation wheel through a connection rope; the opening is disposed on a rotational radius of the gripper.

20 Claims, 10 Drawing Sheets

(56) References Cited

U.S. PATENT DOCUMENTS

| | | | | |
|---|---|---|---|---|
| 2012/0129424 | A1* | 5/2012 | Payne | A63H 18/00<br>446/476 |
| 2017/0252660 | A1* | 9/2017 | Jungco | A63H 19/34 |

* cited by examiner

CRANE MACHINE WITH ROTATABLE ARM

TECHNICAL FIELD

The present disclosure relates to technical field of toy equipment, especially relates to a crane machine with a rotatable arm.

BACKGROUND

A conventional crane machine is required to be controlled up and down, left and right, front and back for movement in grabbing items, for sending the items to a designated position. For a crane machine which is small and mainly designed for children, the three directions of the control are more cumbersome, which has a greater difficulty requirement in operation for children and is not conducive to the popularization of the product.

SUMMARY OF THE DISCLOSURE

The main purpose of the present disclosure is to propose a crane catching machine with a rotatable arm, aiming to reduce the difficulty of operation.

In order to realize the above purpose, the present disclosure proposes a crane machine with a rotatable arm, including: a main body, defining a holding cavity and a conveying channel; wherein the conveying channel includes an opening that is in communication with the holding cavity; the rotatable arm, arranged in the holding cavity; wherein the rotatable arm is rotatably connected to the main body to be rotatable around a centerline in a vertical direction; a rotation drive assembly, including a first driving member configured to drive the rotatable arm to rotate around the centerline; an elevation drive assembly, arranged in the rotatable arm and including a second driving member and a rotation wheel; wherein the second driving member is configured to drive the rotation wheel to rotate; and a gripper, connected to the rotation wheel through a connection rope; wherein the rotation wheel is rotatable to change a number of turns of the connection rope on the rotation wheel; the opening is disposed on a rotational radius of the gripper.

In some embodiments, the rotation drive assembly further includes a linkage gear fixed to the rotatable arm, and the first driving member is configured to drive the linkage gear to rotate.

In some embodiments, the rotation drive assembly further includes a sector gear and one or more slave gears; a side of the sector gear is fixed to the first driving member, and another side of the sector gear has serrated teeth to engage with the one or more slave gears; the linkage gear engages with the one or more slave gears; the first driving member is configured to rotate the sector gear, for driving the one or more slave gears, the linkage gear, and the rotatable arm in association.

In some embodiments, the main body is arranged with a curved guide groove, and the first driving member is configured to slidably cooperate with the curved guide groove; a circle center of the curved guide groove coincides with a rotation center of the sector gear.

In some embodiments, the main body includes a base, an upper surface of the base constitutes a bottom wall of the holding cavity, and the upper surface of the base further defines a pocket hole; the pocket hole is disposed outside the holding cavity, and the pocket hole is curved in a horizontal direction; an interior of the base defines the curved guide groove, and the first driving member includes a handle portion and a guide rail; the guide rail is fixed to the sector gear and configured to slidably cooperate with the curved guide groove, a lower end of the handle portion extends into the base and is connected to the guide rail, and an upper end of the handle portion is exposed outside the base from the pocket hole.

In some embodiments, a bottom wall of the holding cavity defines a curved groove, and a circle center of the curved groove coincides with a rotation center of the rotatable arm; the curved groove has an inner groove wall and an outer groove wall that are disposed in opposite directions and each in a curved shape, wherein a radius of the inner groove wall is less than the rotational radius of the gripper, and a radius of the outer groove wall is greater than the rotational radius of the gripper.

In some embodiments, the rotatable arm includes a vertical section and a horizontal section; the horizontal section is connected to a top of the vertical section, and the horizontal section is arranged with the rotation wheel; the rotatable arm is rotatable with the vertical section as a center.

In some embodiments, the elevation drive assembly further includes a first rotation shaft; the rotation wheel includes a first rotation wheel and a second rotation wheel; the first rotation wheel is fixedly connected to the first rotation shaft, and the second rotation wheel is movably connected to the first rotation shaft to be rotatable relative to the first rotation shaft; the crane machine further includes a resilient member, the first rotation wheel is arranged with a first limiting portion, and the second rotation wheel is arranged with a second limiting portion; in a first state, the resilient member abuts against the second rotation wheel to limit the second rotation wheel from rotating with the first rotation wheel; in a second state, the first limiting portion abuts against the second limiting portion to make the first rotation wheel drive the second rotation wheel to rotate synchronously; the connection rope includes a first rope body and a second rope body; two ends of the first rope body are connected to the gripper and the first rotation wheel, respectively; the first rotation wheel is configured to rotate to make the first rope body coiled on the first rotation wheel; the gripper is in an open state when the first rope body is in a slack state, and the gripper is in a closed state when the first rope body is in a taut state; two ends of the second rope body are connected to the gripper and the second rotation wheel, respectively; the second rotation wheel is configured to rotate to make the second rope body coiled on the second rotation wheel, for controlling a lifting of the gripper.

In some embodiments, the first limiting portion is arranged on a side of the first rotation wheel facing the second rotation wheel, and the second limiting portion is arranged on a side of the second rotation wheel facing the first rotation wheel, with the first limiting portion being a protrusion, and the second limiting portion being a groove; in the first state, the protrusion is slidable within the groove; in the second state, the protrusion abuts against a groove wall of the groove.

In some embodiments, the resilient member includes a rigid member and a spring; a peripheral side of the second rotation wheel includes serrated teeth; in the first state, the spring has a tendency to tighten the rigid member and teeth grooves of the second rotation wheel.

In some embodiments, the elevation drive assembly further includes a first gear, a second gear, a third gear, a fourth gear, a fifth gear, a third rotation shaft, and a fourth rotation shaft; the first gear is fixedly connected to the third rotation shaft, and the first gear is further connected to an output shaft of the second driving member; the second gear is movably connected to the third rotation shaft to be rotatable around the third rotation shaft and axially movable along the third rotation shaft; the third gear and the fourth gear are each fixedly connected to the fourth rotation shaft, and the third gear further engages with the second gear; the fifth gear is fixedly connected to the first rotation shaft, and the fifth gear further engages with the fourth gear; in a first motion state, the first gear and the second gear rotate synchronously by abutting against each other; in a first locking state, the first gear rotates and the second gear stops rotating.

In the technical scheme proposed in the embodiments of the present disclosure, when the gripper rotates around a centerline in the vertical direction, the gripper can simultaneously realize the movement in both the front and back and the left and right directions, such that only the first driving member can realize the movement in multiple directions of the gripper, without the need to set up a driving member for the front and back and the left and right directions. In this way, the control method is relatively simple with low operating difficulty, which is conducive to the popularization of the product and also favorable to the simplification of the product structure.

BRIEF DESCRIPTION OF THE DRAWINGS

In order to more clearly illustrate the technical solutions in the embodiments of the present disclosure, the accompanying drawings to be used in the description of the embodiments will be briefly introduced below, and it is obvious that the accompanying drawings in the following description are only some of the embodiments of the present disclosure, and other accompanying drawings can be obtained according to these drawings for those skilled in the art without giving creative labor.

FIG. 4 is a structural schematic view of a rotation drive assembly and a rotatable arm in

FIG. 2.

REFERENCE NUMERALS

| No. | Name | No. | Name | No. | Name |
|---|---|---|---|---|---|
| 10 | main body | 321 | linkage gear | 474 | third rotation shaft |
| 11 | conveying channel | 322 | sector gear | 475 | fourth rotation shaft |
| 12 | opening | 323 | slave gear | 476 | spacer |
| 13 | base | 401 | second driving member | 48 | rotation wheel |
| 14 | housing | 402 | second gear train | 481 | first rotation wheel |
| 15 | curved guide groove | 41 | first rotation shaft | 4811 | first limiting portion |
| 16 | pocket hole | 42 | second rotation shaft | 482 | second rotation wheel |
| 17 | curved groove | 43 | first limiting gear | 4821 | second limiting portion |
| 171 | inner groove wall | 44 | second limiting gear | 49 | resilient member |
| 172 | outer groove wall | 441 | first stop | 491 | rigid member |
| 20 | rotatable arm | 45 | first gear | 492 | spring |
| 21 | vertical section | 451 | limiting groove | 50 | connection rope |
| 22 | horizontal section | 46 | second gear | 51 | first rope body |
| 23 | second stop | 461 | limiting protrusion | 52 | second rope body |
| 31 | first driving member | 462 | side surface | 60 | gripper |
| 311 | handle portion | 471 | third gear | 61 | fixed rod |
| 312 | guide rail | 472 | fourth gear | 62 | movable rod |
| 32 | first gear train | 473 | fifth gear | 63 | connection arm |
| | | | | 64 | gripping arm |

DETAILED DESCRIPTION

The technical solutions in the embodiments of the present disclosure will be described clearly and completely in the following in conjunction with the accompanying drawings in the embodiments of the present disclosure, and it is obvious that the described embodiments are only a part of the embodiments of the present disclosure and not all of the embodiments. Based on the embodiments in the present disclosure, all other embodiments obtained by those skilled in the art without making creative labor fall within the scope of the present disclosure.

It is to be noted that in the description of the present disclosure, when the terms "first", "second", etc. appear, the terms "first", "second, etc. are intended only to facilitate the description of different parts or names, and are not to be understood as indicating or implying sequential relationships, relative importance, or implicitly specifying the number of technical features indicated. As a result, a feature defined with "first" or "second" may include at least one such feature, either explicitly or implicitly. In addition, when "and/or" appears throughout the text, it is meant to include three concurrent solutions, and in the case of "A and/or B", it indicates a solution including A alone, B alone, and both A and B.

The embodiments of the present disclosure propose a crane machine having a rotatable arm, and the crane machine may be applied as a small tabletop crane machine suitable for use by children. Of course, the crane machine may also be applied in other scenarios.

Figure 1:
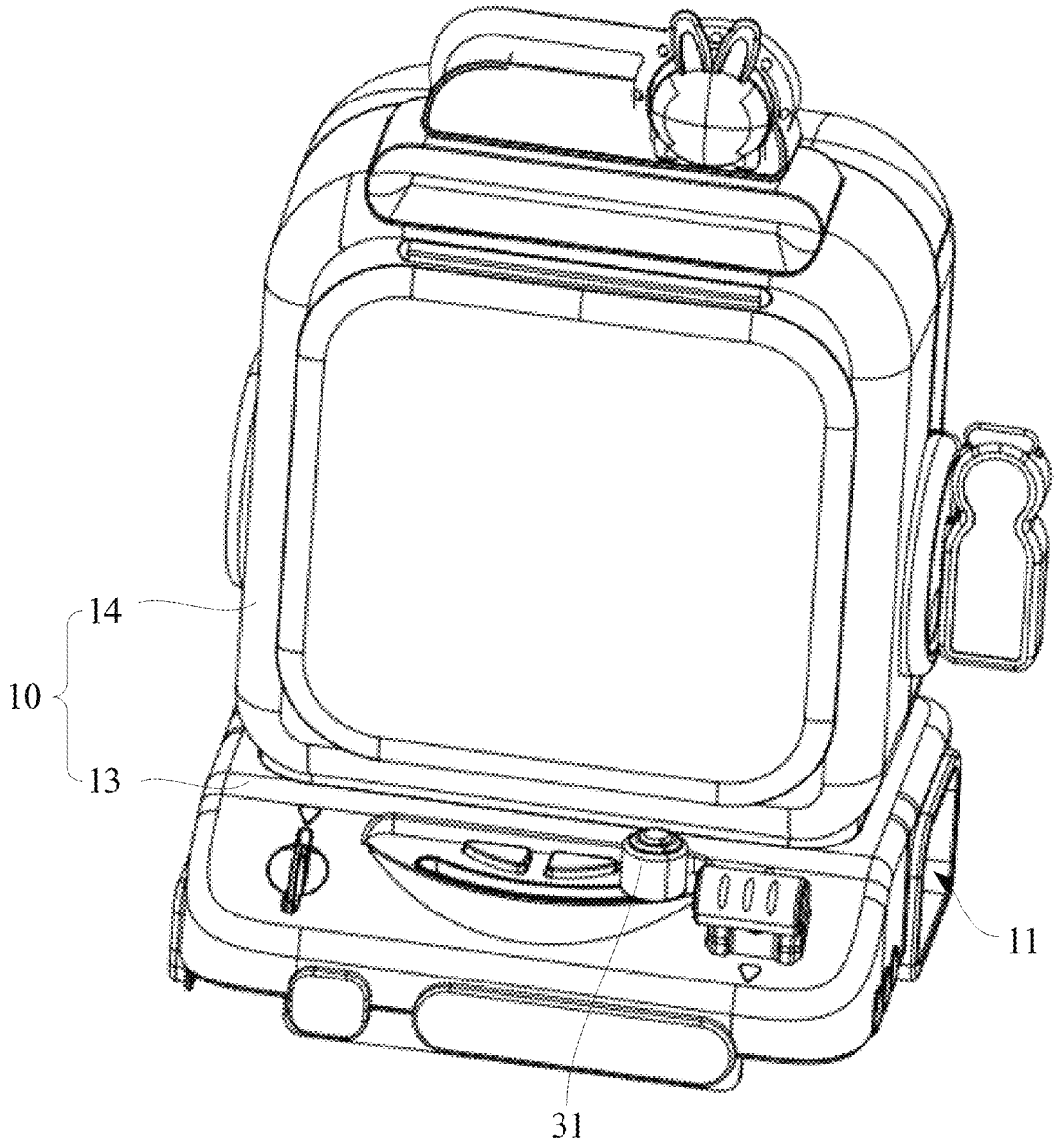
FIG. 1 is a structural schematic view of a crane machine according to some embodiments of the present disclosure.
Figure 2:
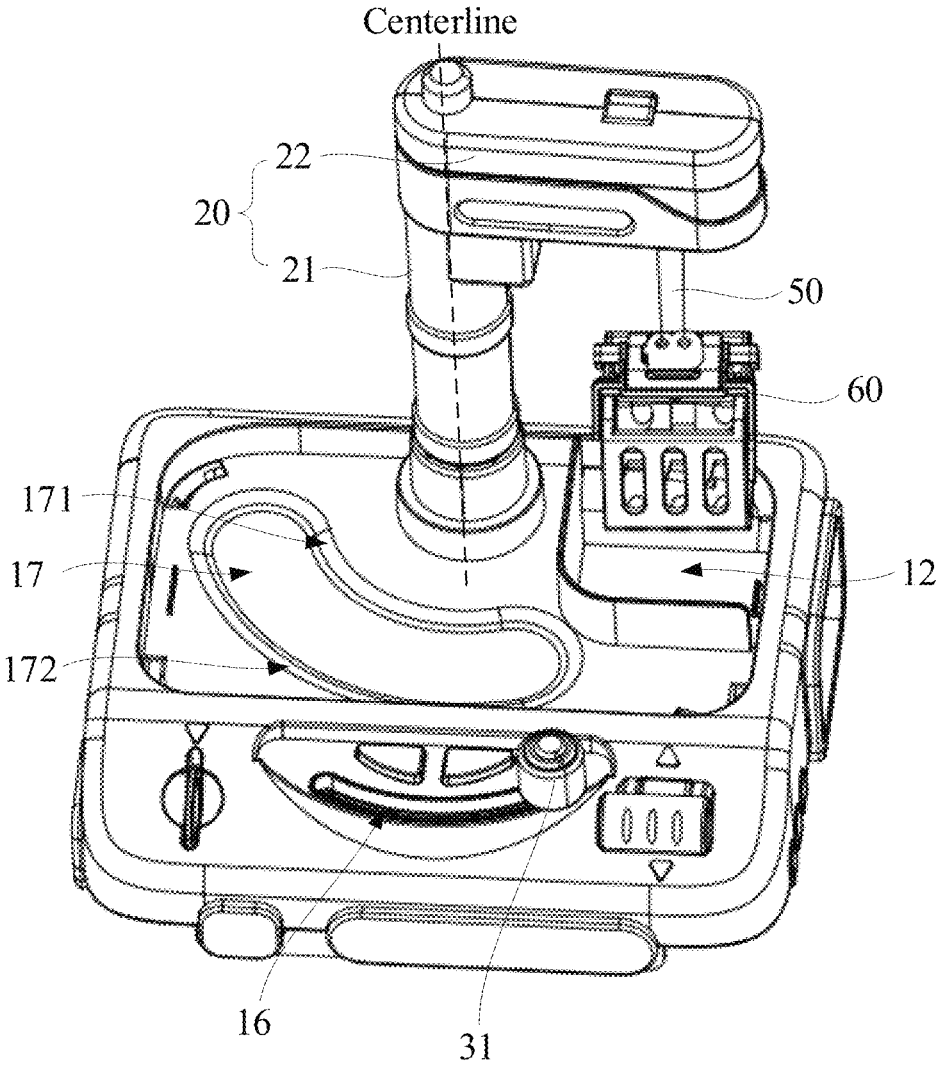
FIG. 2 is a partial structural schematic view of the crane machine in FIG. 1.

Referring to FIGS. 1 and 2 together, the crane machine includes a main body 10; the main body 10 defines a holding cavity (not labeled) and a conveying channel 11, the conveying channel 11 passing through both ends of the main body 10; an end of the conveying channel 11 has an opening 12 that is in communication with the holding cavity, and the other end of the conveying channel 11 is connected to an outside world. The holding cavity is configured to hold an item to be grabbed, such as a doll, and when the item is grabbed it can be dropped into the conveying channel 11.

In some embodiments, the main body 10 includes a base 13 and a housing 14; the housing 14 has an opening facing downwardly, and the base 13 is disposed at a bottom of the housing 14 to block the downwardly facing opening of the housing 14, so as to jointly enclose with the housing 14 to form the holding cavity, i.e., an upper surface of the base 13 constitutes a bottom wall of the holding cavity. The conveying channel 11 is disposed in the base 13, and the opening 12 of the conveying channel 11 is disposed on the upper surface of the base 13. In some embodiments, the housing 14 and the base 13 are each substantially square in shape.

Referring to FIGS. 4 to 7, the crane machine includes: a rotatable arm 20, a rotation drive assembly, an elevation drive assembly, and a gripper 60.

The rotatable arm 20 is arranged in the holding cavity, and the rotatable arm 20 is rotatably connected to the main body 10 to be rotatable around a centerline in a vertical direction.

Figure 3:
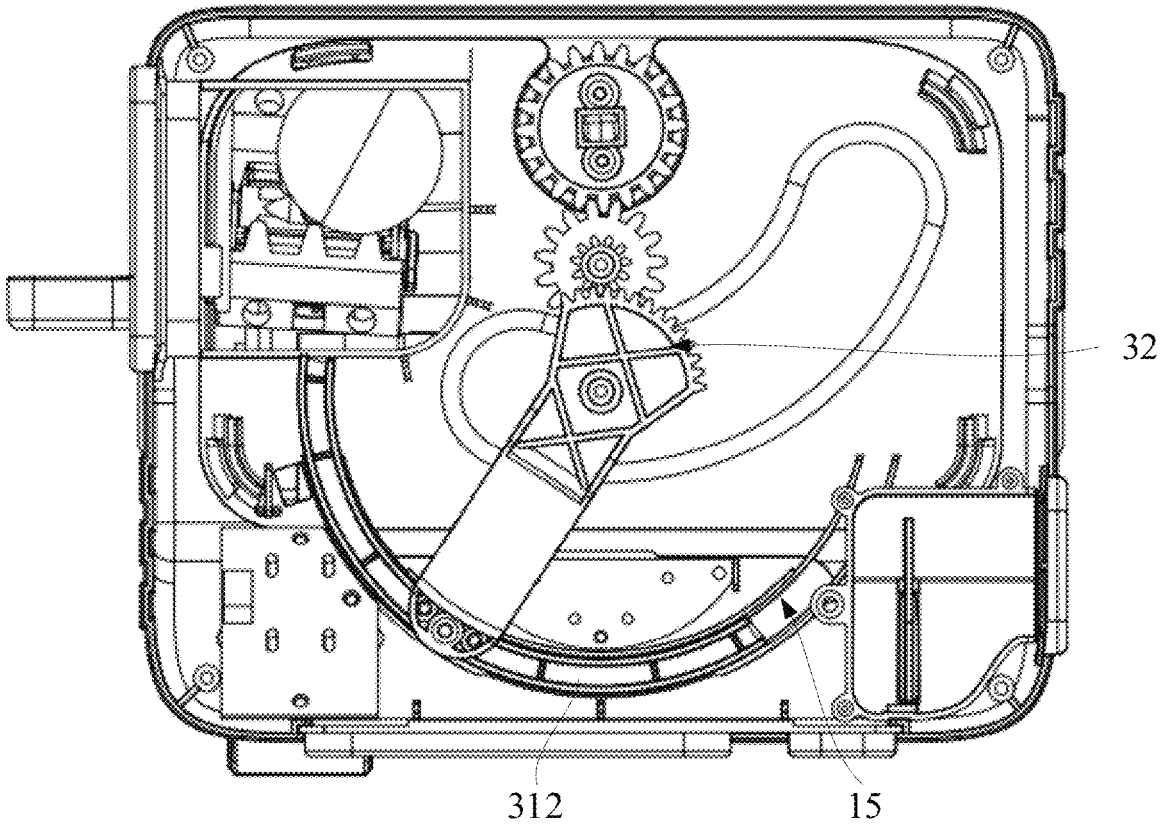
FIG. 3 is a bottom view of the crane machine in FIG. 1.
Figure 4:
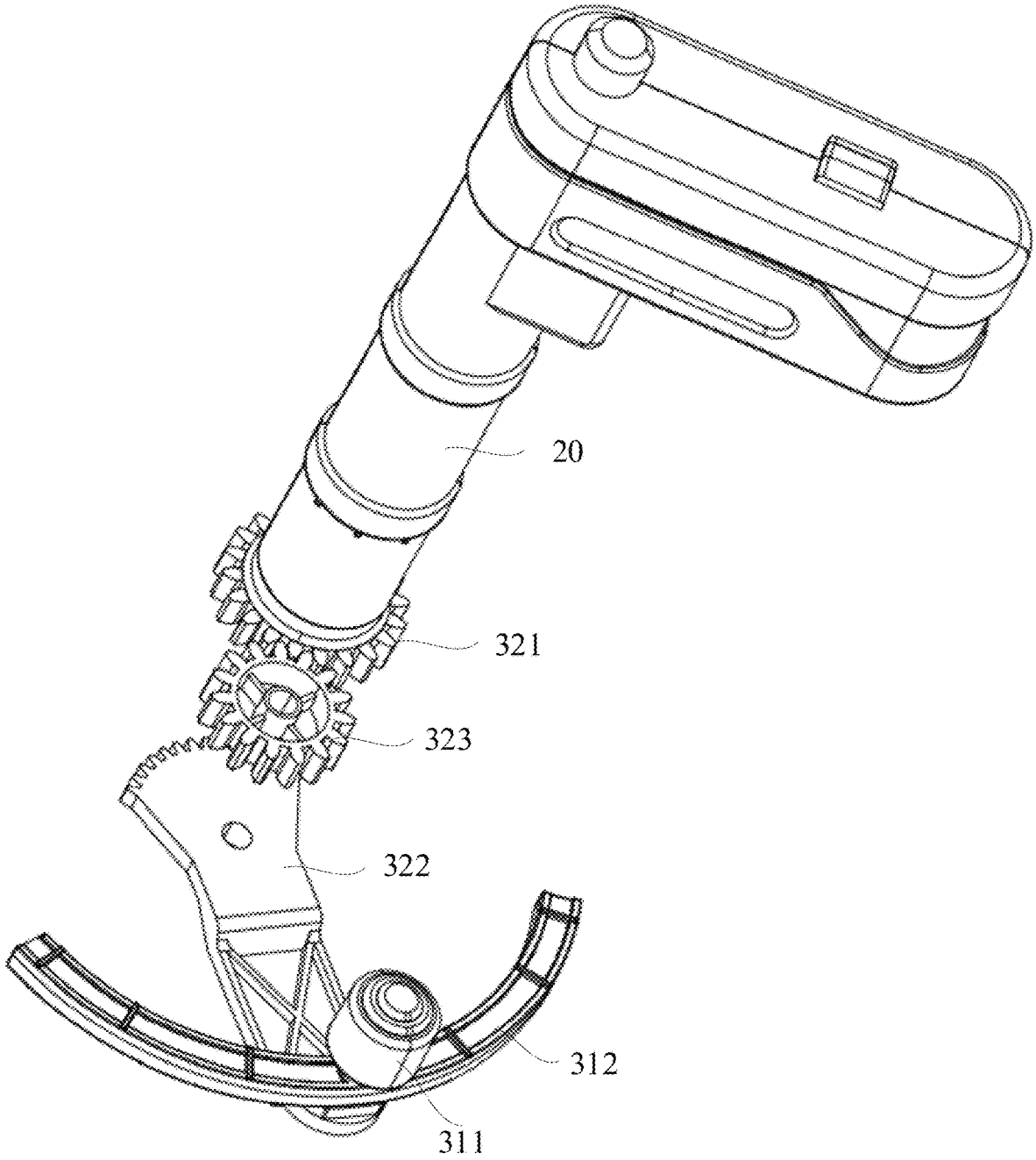
Figure 5:
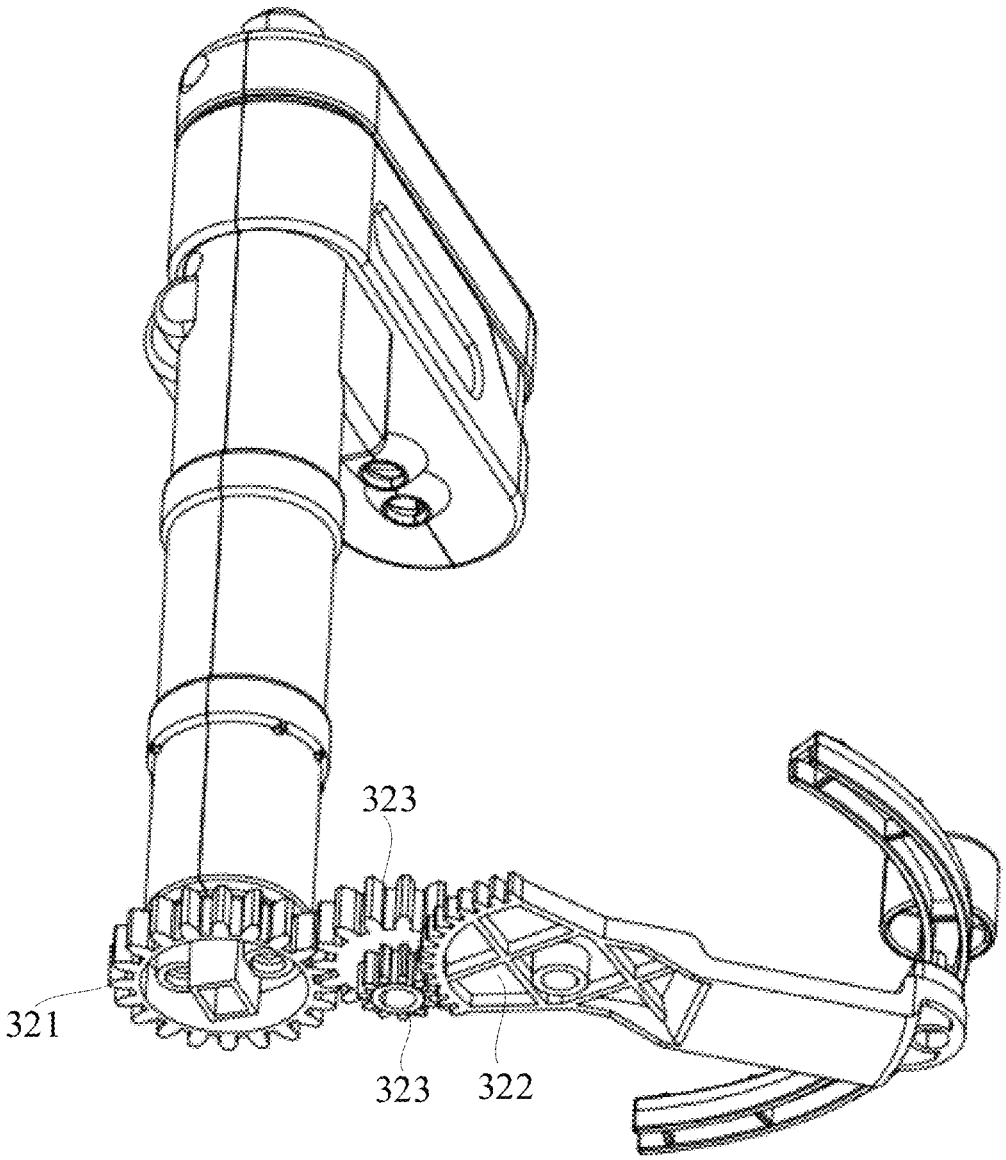
FIG. 5 is another structural schematic view of the rotation drive assembly and the rotatable arm in FIG. 4.

Referring to FIGS. 3 to 5, the rotation drive assembly includes a first driving member 31 and a first gear train 32; the first gear train 32 includes a linkage gear 321 that is fixed to the rotatable arm 20, and the first driving member 31 is configured to drive the first gear train 32 to rotate so as to cause the rotatable arm 20 to rotate relative to the main body 10.

Figure 6:
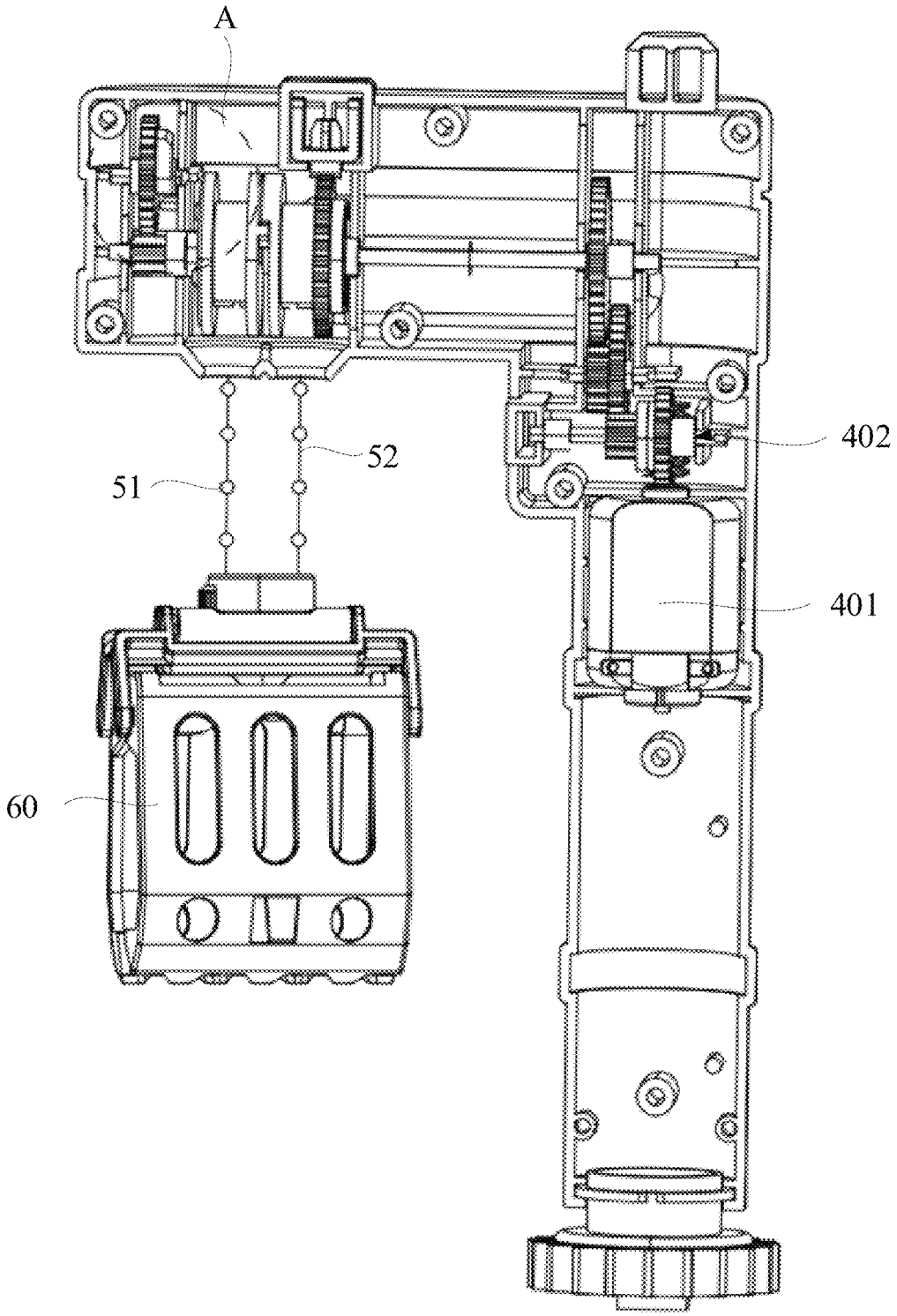
FIG. 6 is a structural schematic view of a rotatable arm and a gripper in FIG. 2.
Figure 7:
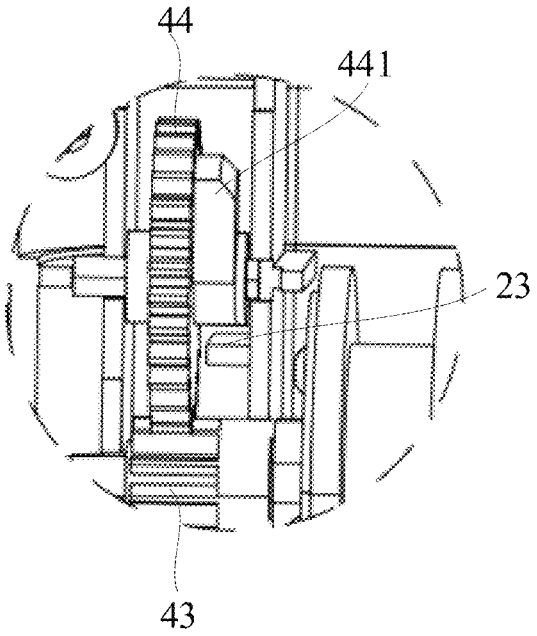
FIG. 7 is an enlarged view at area A in FIG. 6.
Figure 8:
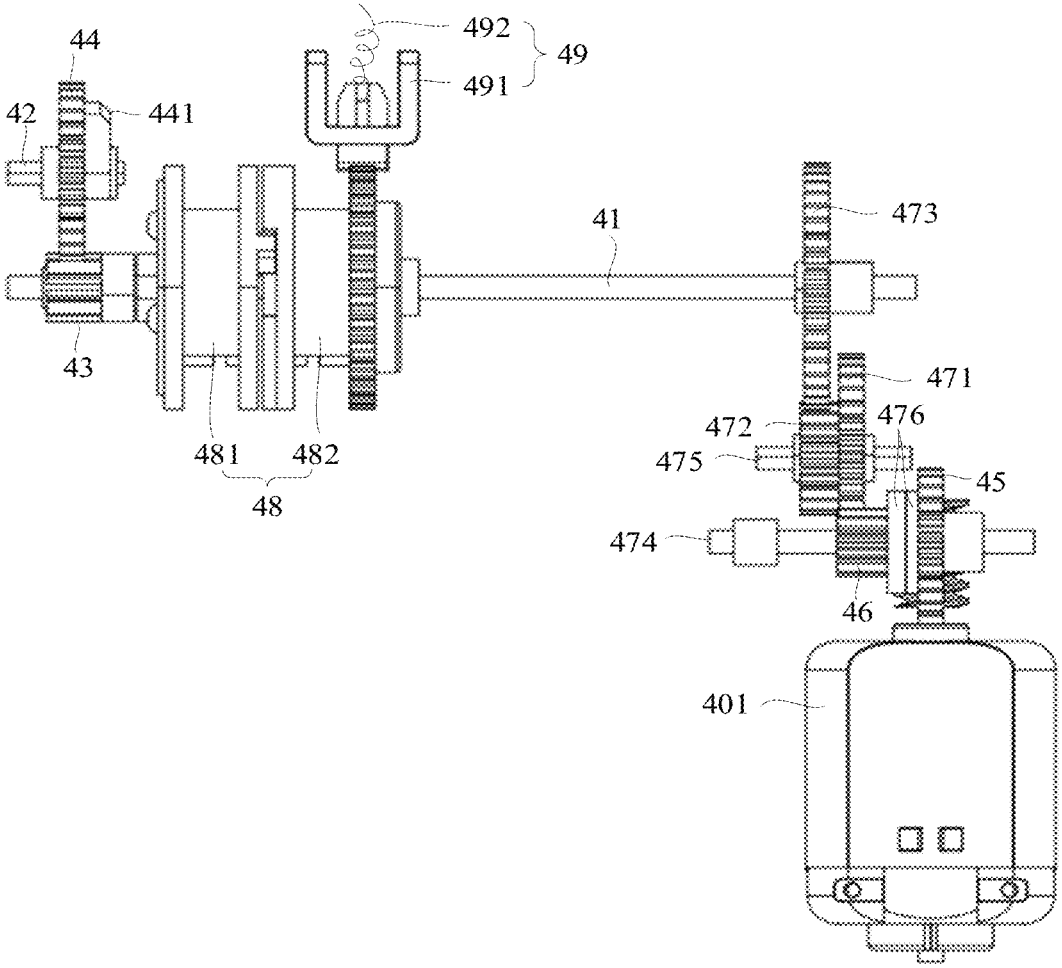
FIG. 8 is a structural schematic view of an elevation drive assembly in FIG. 6.

Referring to FIGS. 6 and 8 together, the elevation drive assembly is arranged in the rotatable arm 20 and includes a second driving member 401, a second gear train 402, and a rotation wheel 48; the second gear train 402 includes a first rotation shaft 41, and the rotation wheel 48 is arranged on the first rotation shaft 41; the second driving member 401 is configured to drive the second gear train 402 to rotate so as to cause the rotation wheel 48 to rotate.

The gripper 60 is connected to the rotation wheel 48 through a connection rope 50, and the rotation wheel 48 is rotated to change a number of turns of the connection rope 50 on the rotation wheel 48; the opening 12 is disposed on a rotational radius of the gripper 60.

Specifically, when the first driving member 31 drives the first gear train 32 to rotate, the linkage gear 321 in the first gear train 32 rotates together, the linkage gear 321 drives the rotatable arm 20 to rotate together relative to the main body 10 and around the centerline in the vertical direction, and the gripper 60 on the rotatable arm 20 rotates accordingly. In addition, when the second driving member 401 drives the second gear train 402 to rotate, the rotation wheel 48 on the second gear train 402 also rotates together, such that the connection rope 50 increases or decreases the number of coils on the rotation wheel 48, and the gripper 60 thereby performs a lifting and lowering movement. In this way, the gripper 60 can grasp an item near the rotational radius and transport the item to the opening 12 located at the rotational radius.

In the embodiments, when the gripper 60 rotates around a centerline in the vertical direction, the gripper 60 can simultaneously realize the movement in both the front and back and the left and right directions, such that only the first driving member 31 can realize the movement in multiple directions of the gripper 60, without the need to set up a driving member for the front and back and the left and right directions. In this way, the control method is relatively simple with low operating difficulty, which is conducive to the popularization of the product and also favorable to the simplification of the product structure.

It is noted that the rotational radius of the gripper 60 refers to the rotational radius of a center axis of the gripper, which is in the vertical direction. When a first rope body 51 and a second rope body 52 are arranged, the center axis of the gripper may be located in the middle of the first rope body 51 and the second rope body 52.

The opening 12 being disposed on the rotational radius of the gripper 60 means that when the gripper 60 is rotated to be located directly above the opening 12, a positive projection of the gripper 60 on the base 13 at least partially coincides with the opening 12. In some embodiments, when the gripper 60 is in a closed state, the positive projection of the gripper 60 on the base 13 entirely falls within the opening 12.

The rotatable arm 20 rotates around the centerline in the vertical direction, which refers to a virtual line substantially perpendicular to the upper surface of the base 13, i.e., a rotation axis of the rotatable arm 20.

Referring again to FIGS. 3 to 5, in some embodiments, the first gear train 32 includes a sector gear 322 and one or more slave gears 323; a side of the sector gear 322 is fixed to the first driving member 31, and another side of the sector gear 322 has serrated teeth to engage the one or more slave gears 323; the linkage gear 321 engages with the one or more slave gears 323. When the first driving member 31 rotates the sector gear 322, the one or more slave gears 323, the linkage gear 321, and the rotatable arm 20 are driven in association.

Specifically, when one slave gear 323 is arranged, the slave gear 323 engages with both the sector gear 322 and the linkage gear 321. When multiple, for example, two slave gears 323 are arranged, one of the slave gears 323 is engaged with the sector gear 322 and the other slave gear 323 is engaged with the linkage gear 321, and, the two slave gears 323 are coaxially arranged and fixed to each other.

The setting of the sector gear 322 can limit a rotation angle of the first gear train 32, such that the rotatable arm 20 is rotated within a certain range, which avoids the rotatable arm 20 from colliding with the main body 10. The sector gear 322 may be substantially in the shape of an elongated strip, and an end of the sector gear 322 in a length direction thereof is arranged with the serrated teeth, and the other end is fixed to the first driving member 31.

In some embodiments, the first gear train 32 is arranged inside the base 13, which may avoid the first gear train 32 from being exposed.

Further, the main body 10 is arranged with a curved guide groove 15, and the first driving member 31 is configured to slidably cooperate with the curved guide groove 15; a circle center of the curved guide groove 15 coincides with a rotation center of the sector gear 322. The curved guide groove 15 is arranged to provide guidance and restriction for the movement of the first driving member 31, guiding the first driving member 31 to move according to a predetermined trajectory.

In the embodiments, the first driving member 31 may be a motor or a manual driving member. In some embodiments, the first driving member 31 is a manual driving member, which is simple to operate and less costly. Specifically, the main body 10 includes the base 13, the upper surface of the base 13 constitutes the bottom wall of the holding cavity, and the upper surface of the base 13 further defines a pocket hole 16; the pocket hole 16 is disposed outside the holding cavity, and the pocket hole 16 is curved in the horizontal direction. The interior of the base 13 further defines the curved guide groove 15, and the first driving member 31 includes a handle portion 311 and a guide rail 312; the guide rail 312 is fixed to the sector gear 322 and slidably cooperates with the curved guide groove 15, a lower end of the handle portion 311 extends into the base 13 and is connected to the guide rail 312, and an upper end of the handle portion 311 is exposed outside the base 13 from the pocket hole 16. When the handle portion 311 is pushed, the handle portion 311 moves in the horizontal direction within the pocket hole 16, and the curved pocket hole 16 guides the handle portion 311 in a curved movement. The handle portion 311 drives the guide rail 312 to slide in an arc shape within the curved guide groove 15, and the sector gear 322 fixed with the guide rail 312 rotates together. Therefore, the user only needs to push the handle portion 311 in the left-right direction to realize the left-right rotation of the gripper 60.

In some embodiments, the guide rail 312 is curved. Of course, in other embodiments, the guide rail 312 may be in the shape of a square block or a sphere.

Referring again to FIG. 2, further, the bottom wall of the holding cavity, i.e., the upper surface of the base 13, defines a curved groove 17, and a circle center of the curved groove 17 coincides with a rotation center of the rotatable arm 20. The curved groove 17 has an inner groove wall 171 and an outer groove wall 172 that are disposed in opposite directions and each in a curved shape, where a radius of the inner groove wall 171 is less than the rotational radius of the gripper 60, and a radius of the outer groove wall 172 is greater than the rotational radius of the gripper 60. In the embodiments, the inner groove wall 171 and the outer groove wall 172 are concentrically provided, and the radius of the inner groove wall 171 is less than the radius of the outer groove wall 172. Since the rotational radius of the gripper 60 is between the radii of the inner groove wall 171 and the outer groove wall 172, the gripper 60 can grasp the item in the curved groove 17. The setting of the curved groove 17 allows the items to be placed more centrally within the curved groove 17, which is conducive to grasping by the gripper 60. For the smaller size of the gripper, it is more favorable for the items to be clustered.

In some embodiments, the rotatable arm 20 is L-shaped. Specifically, the rotatable arm 20 includes a vertical section 21 and a horizontal section 22; the rotatable arm 20 is capable of rotating with the vertical section 21 as a center, the horizontal section 22 is connected to a top of the vertical section 21, and the horizontal section 22 is arranged with the rotation wheel 48. The L-shaped rotatable arm 20 may avoid the gripper 60 from colliding with the vertical section 21 when the gripper 60 is connected.

Both an upper end and a lower end of the vertical segment 21 are rotatably connected to a cavity wall of the holding cavity, respectively, such that a support point can be provided at both the upper end and the lower end of the vertical segment 21 for stable rotation.

In some embodiments, an interior of the rotatable arm 20 is hollow, and the elevation drive assembly is disposed in the interior of the rotatable arm 20, such that the elevation drive assembly is hidden in the interior of the rotatable arm 20, so as to avoid the elevation drive assembly being damaged by collision with other objects in the outside world.

Referring again to FIGS. 8 to 10, the rotation wheel 48 includes a first rotation wheel 481 and a second rotation wheel 482; the first rotation wheel 481 is fixedly connected to the first rotation shaft 41, and the second rotation wheel 482 is movably connected to the first rotation shaft 41 to be rotatable relative to the first rotation shaft 41. The crane machine further includes a resilient member 49, the first rotation wheel 481 is arranged with a first limiting portion 4811, and the second rotation wheel 482 is arranged with a second limiting portion 4821; in a first state, the resilient member 49 abuts against the second rotation wheel 482 to limit the second rotation wheel 482 from rotating with the first rotation wheel 481; in a second state, the first limiting portion 4811 abuts against the second limiting portion 4821 to make the first rotation wheel 481 drive the second rotation wheel 482 to rotate synchronously.

The connection rope 50 includes a first rope body 51 and a second rope body 52; two ends of the first rope body 51 are connected to the gripper 60 and the first rotation wheel 481, respectively; and the first rotation wheel 481 can make the first rope body 51 coiled on the first rotation wheel 481 by rotating; the gripper 60 is in an open state when the first rope body 51 is in a slack state, and the gripper 60 is in a closed state when the first rope body 51 is in a taut state. Two ends of the second rope body 52 are connected to the gripper 60 and the second rotation wheel 482, respectively; the second rotation wheel 482 can make the second rope body 52 coiled on the second rotation wheel 482 by rotating to control the lifting of the gripper 60.

Specifically, an output shaft of the second driving member 401 is transmission-connected to the second gear train 402, and when the second driving member 401 is activated, it can drive the second gear train 402 to rotate. The first rotation wheel 481 is fixedly connected to the first rotation shaft 41 to realize synchronous rotation. In the first state, because the first rotation wheel 481 and the second rotation wheel 482 are not in contact or are only slightly in contact, coupled with the limiting effect of the resilient member 49 on the second rotation wheel 482, the force of the first rotation wheel 481 on the second rotation wheel 482 is less than the force of the resilient member 49 on the second rotation wheel 482; therefore, the second rotation wheel 482 is basically unaffected by the first rotation wheel 481, i.e., the second rotation wheel 482 does not carry on the rotation. In this process, the first rotation wheel 481 may cause the first rope body 51 to reduce the number of coils on the first rotation wheel 481 and to be in the slack state by rotating in a first direction, in which case the gripper 60 is in the open state.

When the first rotation wheel 481 is rotated by a certain angle in the first direction and is in the second state, the first limiting portion 4811 abuts against the second limiting portion 4821, thereby forcing the second rotation wheel 482 to overcome the force of the resilient member 49 and rotate synchronously with the first rotation wheel 481 in the first direction. In this process, the number of coils of the second rope body 52 on the second rotation wheel 482 becomes less, and the gripper 60 gradually descends, while the number of coils of the first rope body 51 on the first rotation wheel 481 likewise becomes less.

When the number of coils of the second rope body 52 on the second rotation wheel 482 is 0, in a case where the second rotation wheel 482 continues to rotate in the first direction, the second rope body 52 will be driven to be re-coiled on the second rotation wheel 482, and the gripper 60 gradually rises.

When it is necessary to drive the gripper 60 down again to grasp the item, the second driving member 401 is reversed, and the above steps are repeated again, in which the movement direction of the first rotation wheel 481 and the second rotation wheel 482 is opposite to the first direction.

For the crane machine of the present disclosure, when the gripper 60 descends, the gripper 60 is opened to realize the grasping of the doll or other items; when the gripper 60 is required to rise, the gripper 60 is closed to grasp the doll. In this way, the opening and closing of the gripper 60 can be changed with the lifting movement, that is, the lifting movement of the gripper 60 and the opening and closing movement are controlled by the same motor. Therefore, there is no need to operate separately, and the two functions can be realized by only one operation. In this way, the operation of the gripper 60 is simple and convenient, and the user experience is better, which is suitable for operation by smaller children.

Figure 9:
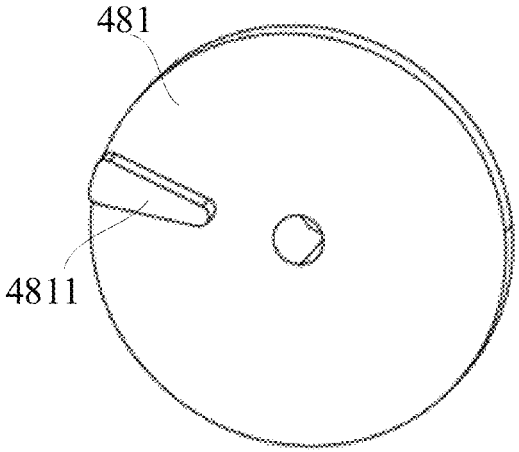
FIG. 9 is a structural schematic view of a first rotation wheel in FIG. 8.
Figure 10:
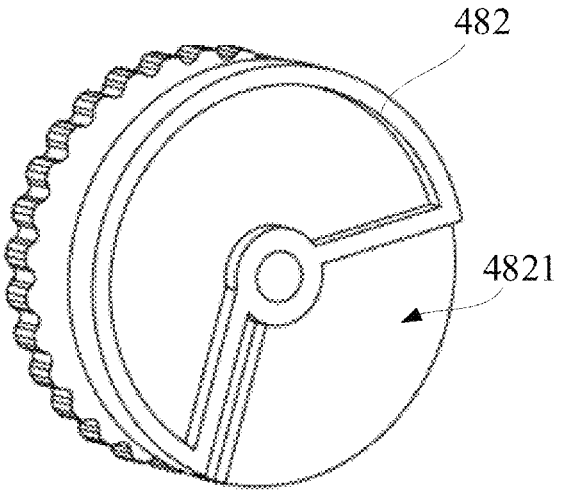
FIG. 10 is a structural schematic view of a second rotation wheel in FIG. 8.

Referring to FIGS. 9 and 10, in some embodiments, the first limiting portion 4811 is arranged on a side of the first rotation wheel 481 facing the second rotation wheel 482, and the second limiting portion 4821 is arranged on a side of the second rotation wheel 482 facing the first rotation wheel 481, with the first limiting portion 4811 being set as a protrusion, and the second limiting portion 4821 being set as a groove. In the first state, the protrusion is able to slide within the groove; in the second state, the protrusion abuts against a groove wall of the groove. In some embodiments, the groove is fan-shaped, and a round center angle of the groove is 120°, such that the protrusion is able to contact the groove wall of the groove when rotated clockwise or counterclockwise by 120°, thereby driving the second rotation wheel 482 to rotate together.

In other embodiments, the first limiting portion 4811 and the second limiting portion 4821 are each a protrusion.

Referring again to FIG. 8, in some embodiments, the resilient member 49 includes a rigid member 491 and a spring 492; a peripheral side of the second rotation wheel 482 includes serrated teeth; in the first state, the spring 492 has a tendency to tighten the rigid member 491 and the teeth grooves of the second rotation wheel 482, in which case the spring 492 is in a compressed state to force the rigid member 491 and the teeth grooves of the second rotation wheel 482 to tighten, exerting a greater resistance to the second rotation wheel 482 to create a greater resistance, thereby preventing the second rotation wheel 482 from rotating. In the second state, the second rotation wheel 482 is driven by the first rotation wheel 481 to generate a greater rotational force, forcing the spring 492 to be further compressed, and the spring 492 drives the rigid member 491 to recede from the tooth grooves of the second rotation wheel 482, in which case the second rotation wheel 482 rotates with the first rotation wheel 481.

In other embodiments, the resilient member 49 may be a V-shaped or U-shaped resilient arm or shrapnel.

An axial cross-section of the first rotation wheel 481 may be "I" shaped to form a shape with a greater diameter at both ends and a less diameter in the middle, so as to facilitate the first rope body 51 to be coiled into the middle region, with the less diameter, of the first rotation wheel 481, such that the two end regions with greater diameters block the first rope body 51 and prevent the first rope body 51 from scuttling out of the ends along the axial direction of the first runner 481.

Similarly, an axial cross-section of the second rotation wheel 482 may be "I" shaped to form a shape with a greater diameter at both ends and a less diameter in the middle, so as to facilitate the second rope body 52 to be coiled into the middle region, with the less diameter, of the second rotation wheel 482, such that the two end regions with greater diameters block the second rope body 52 and prevent the second rope body 52 from scuttling out of the ends along the axial direction of the second rotation wheel 482.

Referring again to FIGS. 7 and 8, further, the second gear train 402 further includes a second rotation shaft 42, a first limiting gear 43, and a second limiting gear 44; the first limiting gear 43 is fixed to the first rotation shaft 41, and the first limiting gear 43 engages with the second limiting gear 44. The second limiting gear 44 is fixed to the second rotation shaft 42, the second limiting gear 44 is arranged with a first stop 441, and the rotatable arm 20 is arranged with a second stop 23; after the second limiting gear 44 rotates in a predetermined angle, the first stop 441 can abut against the second stop 23 to limit the second limiting gear 44 from continuing to rotate in the same direction. In this way, when the second limiting gear 44 is rotated forward and reversed by a predetermined angle, the second stop 441 is able to abut against the second stop 23, thereby limiting the rotation angle of the second limiting gear 44, i.e., limiting the rotation angle of the first rotation wheel 481 fixed to the first rotation shaft 41, and thus limiting the lifting height of the gripper 60.

In some embodiments, the first stop 441 is a protrusion on an end surface of the second limiting gear 44. Similarly, the second stop 23 is a protrusion inside the rotatable arm 20.

When the first stop 441 and the second stop 23 are set up, the second driving member 401 first rotates to drive the gripper 60 down, and then the second driving member 401 then reverses to drive the gripper 60 up, i.e., the rotational direction of the rotation wheel 48 is reversed during the two processes of the gripper 60 going up and going down. Of course, in other embodiments, the first stop 441 and the second stop 23 may not be arranged.

Referring again to FIG. 8, in some embodiments, the second gear train 402 includes a first gear 45, a second gear 46, a third gear 471, a fourth gear 472, a fifth gear 473, a third rotation shaft 474, and a fourth rotation shaft 475. The first gear 45 and the second gear 46 are arranged in separate pieces, the first gear 45 is fixedly connected to the third rotation shaft 474, and the first gear 45 is further connected to the output shaft of the second driving member 401, and the second gear 46 is movably connected to the third rotation shaft 474 to be able to rotate and axially move around the third rotation shaft 474. The third gear 471 and the fourth gear 472 are each fixedly connected to the fourth rotation shaft 475, and the third gear 471 is further engaged with the second gear 46. The fifth gear 473 is fixedly connected to the first rotation shaft 41, and the fifth gear 473 is further engaged with the fourth gear 472.

Specifically, after the second driving member 401 (motor) is activated, the output shaft of the second driving member 401 drives the first gear 45 to rotate, the second gear 46 rotates synchronously with the first gear 45 by abutting against the first gear 45, the second gear 46 drives the third gear 471 to rotate, the fourth gear 472 rotates synchronously by being fixed to the third gear 471, and the fifth gear 473 rotates under the drive of the fourth gear 472. Since the fifth gear 473 is fixed to the first rotation shaft 41, the first rotation shaft 41 rotates accordingly, and the first rotation wheel 481 fixed to the first rotation shaft 41 rotates together.

When the first stop 441 abut against the second stop 23, the second limiting gear 44 stops rotating, forcing the first limiting gear 43 and the first rotation shaft 41 to stop rotating, and then the fifth gear 473, the fourth gear 472, the third gear 471, and the second gear 46 are all forced to stop rotating. In this case, the second driving member 401 is still running and drives the first gear 45 to rotate, so the second gear 46 will move along the axial direction of the third rotation shaft 474, and there is a spacing between the second gear 46 and the first gear 45 or a contact force between the second gear 46 and the first gear 45 becomes smaller, thereby enabling the first gear 45 to rotate relative to the second gear 46, which prevents the second driving member 401 from jamming and rattling.

Further, a spring (not shown) is arranged at an end of the second gear 46 away from the first gear 45; when the first gear 45 and the second gear 46 rotate synchronously, the spring is in a compressed state to push the second gear 46 against the first gear 45. When the first gear 45 rotates relative to the second gear 46, the second gear 46 may squeeze the spring in a direction away from the first gear 45, thereby allowing the first gear 45 to rotate relative to the second gear 46.

Further, the first gear 45 and the second gear 46 may be each arranged with a spacer 476, and the roughness of the surfaces of the two spacers 476 facing each other is large, such that a larger friction is generated. In this way, when the first gear 45 and the second gear 46 are required to rotate synchronously, the two spacers 476 may abut against each other, such that the first gear 45 may drive the second gear 46 to rotate synchronously. When the first gear 45 rotates independently, the two spacers 476 are spaced apart. Of course, in other embodiments, the first gear 45 and the second gear 46 may be in direct contact with each other, and the surfaces in contact are rough.

Figure 11:
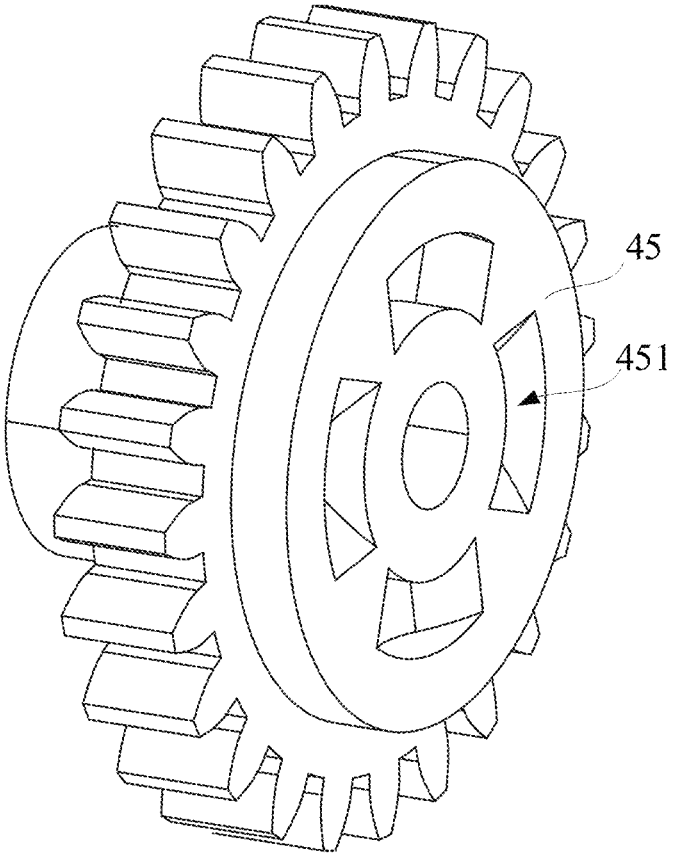
FIG. 11 is a structural schematic view of a first gear in FIG. 8.
Figure 12:
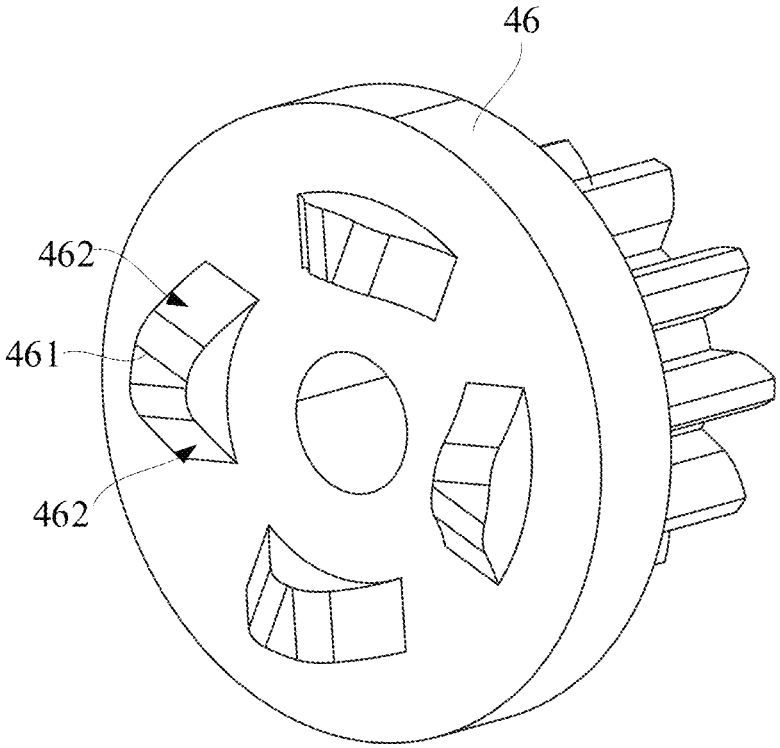
FIG. 12 is a structural schematic view of a second gear in FIG. 8.

Referring to FIGS. 11 and 12, further, a side of the first gear 45 facing the second gear 46 defines a limiting groove 451, and the second gear 46 is arranged with a limiting protrusion 461 adapted to the limiting groove 451. When the first gear 45 and the second gear 46 rotate in synchronization, the limiting protrusion 461 and the limiting groove 451 are inserted to cooperate. When the second gear 46 stops rotating and the first gear 45 continues to rotate under the drive of the second driving member 401, a groove wall of the limiting groove 451 on the first gear 45 gradually pushes out the limiting protrusion 461 in the second gear 46, such that the spring 492 is in a compressed state, in which case the second gear 46 no longer rotates, so as to avoid the second driving member 401 from being burned out caused by the second gear train 402 seizing up.

In some embodiments, the limiting protrusion 461 is tapered such that the size of a tail end of the limiting protrusion 461 is larger and the size of a head end of the limiting protrusion 461 is smaller, a side surface 462 of the limiting protrusion 461 is beveled or curved to serve as a guide, and the groove wall of the limiting groove 451 is adapted to the shape of the limiting protrusion 461, i.e., the limiting groove 451 is set asymptotically in a direction proximate to the groove opening. In this way, the side surface 462 of the limiting protrusion 461 may better move along the groove wall of the limiting groove 451. In addition, the limiting protrusion 461 is curved as a whole, and a circle center of the limiting protrusion 461 coincides with a rotation center of the second gear 46. When multiple limiting protrusions 461 are arranged, the limiting protrusions 461 are distributed on a same reference circle. The curved limiting protrusions 461 adapt to a rotational path of the second gear 46, thereby facilitating the rotation of the limiting protrusion 461 away from the limiting groove 451.

In other embodiments, the first gear 45 is fixed with a spacer 476, and the limiting groove 451 is defined on the spacer 476 of the first gear 45. The second gear 46 is fixed with another spacer 476, and the limiting protrusion 461 is defined on the spacer 476 of the second gear 46.

Of course, other embodiments may have the second gear train 402 arranged in the form of a reduction gear only.

In some embodiments, the first rotation shaft 41, the second rotation shaft 42, the third rotation shaft 474, and the fourth rotation shaft 475 are all parallel to the horizontal section 22, the first rotation shaft 41 and the second rotation shaft 42 are arranged in the horizontal section 22, the third rotation shaft 474 and the fourth rotation shaft 475 are arranged in the vertical segment 21, and the second driving member 401 is also arranged in the vertical segment 21.

Figure 13:
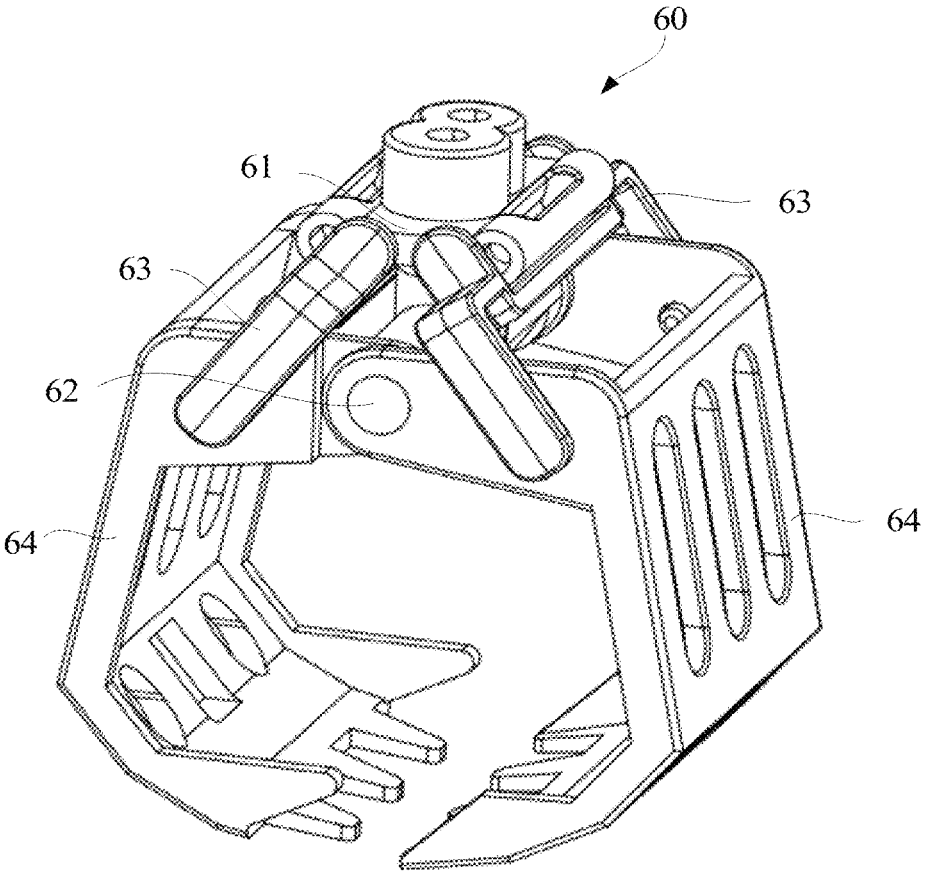
FIG. 13 is a structural schematic view of a gripper in FIG. 6.

Referring again to FIG. 13, in some embodiments, the gripper 60 includes: a fixed rod 61, a movable rod 62, two connection arms 63, and two gripping arms 64; the fixed rod 61 and the movable rod 62 are substantially horizontally disposed; the fixed rod 61 is disposed above the movable rod 62, and the fixed rod 61 and the movable rod 62 are disposed side-by-side; a lower end of the second rope body 52 is connected to the fixed rod 61, and a lower end of the first rope body 51 is connected to the movable rod 62. Two gripping arms 64 are arranged on two opposite sides of the movable rod 62, an upper end of each gripping arm 64 can rotatably cooperate with the movable rod 62, such that the gripping arm 64 is rotatable relative to the movable rod 62, causing lower ends of the two gripping arms 64 to be closed together or away from each other in an open state. An upper end of each connection arm 63 can rotatably cooperate with the fixing rod 61, and a lower end of the connection arm 63 can rotatably cooperate with the gripping arm 64. The two connection arms 63 and the two clamping arms 64 are in a one-to-one correspondence.

Specifically, when the first rope body 51 is in the slack state, the movable rod 62 descends relative to the fixed rod 61 under gravity, in which case the lower ends of the two gripping arms 64 are opened. When the first rope body 51 is in the taut state, the movable rod 62 is pulled upwardly by the first rope body 51 until it comes into contact with the fixed rod 61, in which case the lower ends of the two gripping arms 64 are closed.

Finally, it should be noted that the above embodiments are only intended to illustrate the technical solutions of the present disclosure, not to limit them; although the present disclosure has been described in detail with reference to the foregoing embodiments, those skilled in the art should understand that it is still possible to modify the technical solutions recorded in the foregoing embodiments, or to replace some of the technical features therein with the same; and these modifications or replacements do not cause the corresponding technical solutions to depart from the essence of the technical solutions of the present disclosure.

What is claimed is:

1. A crane machine with a rotatable arm, comprising:

a main body, defining a holding cavity and a conveying channel; wherein the conveying channel comprises an opening that is in communication with the holding cavity;

the rotatable arm, arranged in the holding cavity; wherein the rotatable arm is rotatably connected to the main body to be rotatable around a centerline in a vertical direction;

a rotation drive assembly, comprising a first driving member configured to drive the rotatable arm to rotate around the centerline;

an elevation drive assembly, arranged in the rotatable arm and comprising a second driving member and a rotation wheel; wherein the second driving member is configured to drive the rotation wheel to rotate; and a gripper, connected to the rotation wheel through a connection rope; wherein the rotation wheel is rotated to coil or uncoil the connection rope to lift or lower the gripper; the opening is disposed on a rotational radius of the gripper;

wherein the rotation drive assembly further comprises a sector gear; the main body is arranged with a curved guide groove, and the first driving member is configured to slidably cooperate with the curved guide groove; a circle center of the curved guide groove coincides with a rotation center of the sector gear.

2. The crane machine according to claim 1, wherein the rotation drive assembly further comprises a linkage gear fixed to the rotatable arm, and the first driving member is configured to drive the linkage gear to rotate.

3. The crane machine according to claim 2, wherein the rotation drive assembly further comprises one or more slave gears; a side of the sector gear is fixed to the first driving member, and another side of the sector gear has serrated teeth to engage with the one or more slave gears; the linkage gear engages with the one or more slave gears;

the first driving member is configured to rotate the sector gear, for driving the one or more slave gears, the linkage gear, and the rotatable arm in association.

4. The crane machine according to claim 1, wherein the main body comprises a base, an upper surface of the base constitutes a bottom wall of the holding cavity, and the upper surface of the base further defines a pocket hole; the pocket hole is disposed outside the holding cavity, and the pocket hole is curved in a horizontal direction;

an interior of the base defines the curved guide groove, and the first driving member comprises a handle portion and a guide rail; the guide rail is fixed to the sector gear and configured to slidably cooperate with the curved guide groove, a lower end of the handle portion extends into the base and is connected to the guide rail, and an upper end of the handle portion is exposed outside the base from the pocket hole.

5. The crane machine according to claim 1, wherein a bottom wall of the holding cavity defines a curved groove, and a circle center of the curved groove coincides with a rotation center of the rotatable arm;

the curved groove has an inner groove wall and an outer groove wall that are disposed in opposite directions and each in a curved shape, wherein a radius of the inner groove wall is less than the rotational radius of the gripper, and a radius of the outer groove wall is greater than the rotational radius of the gripper.

6. The crane machine according to claim 1, wherein the rotatable arm comprises a vertical section and a horizontal section; the horizontal section is connected to a top of the vertical section, and the horizontal section is arranged with the rotation wheel; the rotatable arm is rotatable with the vertical section as a center.

7. The crane machine according to claim 1, wherein an interior of the rotatable arm is hollow, and the elevation drive assembly is disposed in the interior of the rotatable arm.

8. A crane machine with a rotatable arm, comprising:

a main body, defining a holding cavity and a conveying channel; wherein the conveying channel comprises an opening that is in communication with the holding cavity;

the rotatable arm, arranged in the holding cavity; wherein the rotatable arm is rotatably connected to the main body to be rotatable around a centerline in a vertical direction;

a rotation drive assembly, comprising a first driving member configured to drive the rotatable arm to rotate around the centerline;

an elevation drive assembly, arranged in the rotatable arm and comprising a second driving member and a rotation wheel; wherein the second driving member is configured to drive the rotation wheel to rotate; and a gripper, connected to the rotation wheel through a connection rope; wherein the rotation wheel is rotated to coil or uncoil the connection rope to lift or lower the gripper; the opening is disposed on a rotational radius of the gripper;

wherein the elevation drive assembly further comprises a first rotation shaft; the rotation wheel comprises a first rotation wheel and a second rotation wheel; the first rotation wheel is fixedly connected to the first rotation shaft, and the second rotation wheel is movably connected to the first rotation shaft to be rotatable relative to the first rotation shaft;

the crane machine further comprises a resilient member, the first rotation wheel is arranged with a first limiting portion, and the second rotation wheel is arranged with a second limiting portion; in a first state, the resilient member abuts against the second rotation wheel to limit the second rotation wheel from rotating with the first rotation wheel; in a second state, the first limiting portion abuts against the second limiting portion to make the first rotation wheel drive the second rotation wheel to rotate synchronously;

the connection rope comprises a first rope body and a second rope body; two ends of the first rope body are connected to the gripper and the first rotation wheel, respectively; the first rotation wheel is configured to rotate to make the first rope body coiled on the first rotation wheel; the gripper is in an open state when the first rope body is in a slack state, and the gripper is in a closed state when the first rope body is in a taut state;

two ends of the second rope body are connected to the gripper and the second rotation wheel, respectively; the second rotation wheel is configured to rotate to make the second rope body coiled on the second rotation wheel, for controlling a lifting of the gripper.

9. The crane machine according to claim 8, wherein the first limiting portion is arranged on a side of the first rotation wheel facing the second rotation wheel, and the second limiting portion is arranged on a side of the second rotation wheel facing the first rotation wheel, with the first limiting portion being a protrusion, and the second limiting portion being a groove; in the first state, the protrusion is slidable within the groove; in the second state, the protrusion abuts against a groove wall of the groove.

10. The crane machine according to claim 8, wherein the resilient member comprises a rigid member and a spring; a peripheral side of the second rotation wheel comprises serrated teeth; in the first state, the spring has a tendency to tighten the rigid member and teeth grooves of the second rotation wheel.

11. The crane machine according to claim 8, wherein the elevation drive assembly further comprises a first gear, a second gear, a third gear, a fourth gear, a fifth gear, a third rotation shaft, and a fourth rotation shaft;

the first gear is fixedly connected to the third rotation shaft, and the first gear is further connected to an output shaft of the second driving member; the second gear is movably connected to the third rotation shaft to be rotatable around the third rotation shaft and axially movable along the third rotation shaft;

the third gear and the fourth gear are each fixedly connected to the fourth rotation shaft, and the third gear further engages with the second gear;

the fifth gear is fixedly connected to the first rotation shaft, and the fifth gear further engages with the fourth gear;

in a first motion state, the first gear and the second gear rotate synchronously by abutting against each other; in a first locking state, the first gear rotates and the second gear stops rotating.

12. The crane machine according to claim 11, wherein the first gear and the second gear are each arranged with a spacer;

when the first gear and the second gear are required to rotate synchronously, the two spacers abut against each other, such that the first gear drives the second gear to rotate synchronously;

when the first gear rotates independently, the two spacers are spaced apart.

13. The crane machine according to claim 11, wherein a side of the first gear facing the second gear defines a limiting groove, and the second gear is arranged with a limiting protrusion adapted to the limiting groove.

14. The crane machine according to claim 13, wherein the limiting protrusion is tapered such that a size of a tail end of the limiting protrusion is larger than a size of a head end of the limiting protrusion; a side surface of the limiting protrusion is beveled or curved to serve as a guide, and a groove wall of the limiting groove is adapted to a shape of the limiting protrusion.

15. The crane machine according to claim 8, wherein the elevation drive assembly further comprises a second rotation shaft, a first limiting gear, and a second limiting gear; the first limiting gear is fixed to the first rotation shaft, and the first limiting gear engages with the second limiting gear; the second limiting gear is fixed to the second rotation shaft, the second limiting gear is arranged with a first stop, and the rotatable arm is arranged with a second stop; after the second limiting gear rotates in a predetermined angle, the first stop abuts against the second stop to limit the second limiting gear from continuing to rotate in a same direction.

16. The crane machine according to claim 15, wherein the first stop is a protrusion on an end surface of the second limiting gear; the second stop is a protrusion inside the rotatable arm.

17. A crane machine with a rotatable arm, comprising:

a main body, defining a holding cavity and a conveying channel; wherein the conveying channel comprises an opening that is in communication with the holding cavity;

the rotatable arm, arranged in the holding cavity; wherein the rotatable arm is rotatably connected to the main body to be rotatable around a centerline in a vertical direction;

a rotation drive assembly, comprising a first driving member configured to drive the rotatable arm to rotate around the centerline;

an elevation drive assembly, arranged in the rotatable arm and comprising a second driving member, a gear train and a rotation wheel; and a gripper, connected to the rotation wheel through a connection rope;

wherein the second driving member drives the gear train to rotate, the gear train drives the rotation wheel to rotate, and the rotation wheel is rotated to coil or uncoil the connection rope to lift or lower the gripper;

an interior of the rotatable arm is hollow; and the second driving member, the gear train and the rotation wheel are all disposed in the interior of the rotatable arm.

18. The crane machine according to claim 17, wherein the rotation drive assembly further comprises a linkage gear fixed to the rotatable arm, and the first driving member is configured to drive the linkage gear to rotate.

19. The crane machine according to claim 18, wherein the rotation drive assembly further comprises a sector gear and one or more slave gears; a side of the sector gear is fixed to the first driving member, and another side of the sector gear has serrated teeth to engage with the one or more slave gears; the linkage gear engages with the one or more slave gears;

the first driving member is configured to rotate the sector gear, for driving the one or more slave gears, the linkage gear, and the rotatable arm in association.

20. The crane machine according to claim 19, wherein the main body is arranged with a curved guide groove, and the first driving member is configured to slidably cooperate with the curved guide groove; a circle center of the curved guide groove coincides with a rotation center of the sector gear.

* * * * *